US006516483B1

(12) United States Patent
VanSteenburg

(10) Patent No.: US 6,516,483 B1
(45) Date of Patent: Feb. 11, 2003

(54) PATIENT SUPPORT SURFACE

(75) Inventor: Kip P. VanSteenburg, Sudbury, MA (US)

(73) Assignee: The OR Group, Inc., Acton, MA (US)

( * ) Notice: Subject to any disclaimer, the term of this patent is extended or adjusted under 35 U.S.C. 154(b) by 0 days.

(21) Appl. No.: 09/537,037

(22) Filed: Mar. 28, 2000

(51) Int. Cl.[7] ..... A47G 9/00; A47C 27/15

(52) U.S. Cl. ..... 5/737; 5/727; 5/740; 5/926; 5/953

(58) Field of Search ..... 5/640, 727, 737, 5/740, 655.9, 925, 926, 953, 486, 497, 499, 722, 490

(56) References Cited

U.S. PATENT DOCUMENTS

| | | | | | |
|---|---|---|---|---|---|
| 3,047,888 | A | * | 8/1962 | Shecter et al. | 5/740 X |
| 3,243,828 | A | * | 4/1966 | McCarty | 5/636 |
| 3,419,920 | A | * | 1/1969 | Maddux, Jr. et al. | 5/722 X |
| 3,521,311 | A | * | 7/1970 | Cohen | 5/727 |
| 3,534,417 | A | * | 10/1970 | Boyles | 5/727 X |
| 3,574,873 | A | | 4/1971 | Weinstein | 5/655.5 |
| 3,846,857 | A | * | 11/1974 | Weinstock | 5/722 X |
| 3,939,508 | A | * | 2/1976 | Hall et al. | 5/727 |
| 4,316,298 | A | | 2/1982 | Russo et al. | 5/722 |
| 4,319,781 | A | * | 3/1982 | Tsuge | 5/925 X |
| 4,405,681 | A | * | 9/1983 | McEvoy | 5/655.9 |
| 4,756,035 | A | * | 7/1988 | Beier | 5/640 |
| 4,864,669 | A | * | 9/1989 | Jones | 5/926 X |
| 4,907,308 | A | | 3/1990 | Leininger et al. | 5/713 |
| 5,016,303 | A | * | 5/1991 | Tanaka et al. | 5/636 |
| 5,022,111 | A | * | 6/1991 | Fenner, Sr. | 5/736 |
| 5,031,261 | A | * | 7/1991 | Fenner, Sr. | 5/736 |
| 5,084,928 | A | * | 2/1992 | Skillington | 5/490 |
| 5,127,115 | A | * | 7/1992 | Williams et al. | 5/497 |
| 5,163,194 | A | * | 11/1992 | Dixon | 5/636 |
| 5,187,952 | A | * | 2/1993 | Zafiroglu | 66/192 |
| 5,247,893 | A | * | 9/1993 | Zafiroglu | 112/475.08 |
| 5,483,709 | A | | 1/1996 | Foster et al. | 5/81.1 R |
| 5,603,133 | A | | 2/1997 | Vrzalik | 5/609 |
| 5,642,543 | A | * | 7/1997 | Huntley | 5/490 X |
| 5,745,940 | A | * | 5/1998 | Roberts et al. | 5/737 X |
| 5,797,154 | A | * | 8/1998 | Contreras | 5/490 X |
| 5,802,646 | A | | 9/1998 | Stolpmann et al. | 5/740 |
| 5,815,865 | A | | 10/1998 | Washburn et al. | 5/713 |
| 5,933,888 | A | | 8/1999 | Foster et al. | 5/604 |
| 5,953,777 | A | * | 9/1999 | Buck | 5/490 X |

(List continued on next page.)

FOREIGN PATENT DOCUMENTS

| | | | | | |
|---|---|---|---|---|---|
| DE | 2235818 | A | * | 1/1974 | 5/727 |
| GB | 2244000 | A | * | 11/1991 | 5/727 |

OTHER PUBLICATIONS

"Surgical Table Accessories catalog, entire catalog especially pp. 21–23", O. R. Direct, 531 Main St., Acton, MA, Fall 1999.

"Product Catalog", entire catalog especially pp. 12–18, Allen Medical Systems, One Post Office Square, Acten, MA, Jan. 1999.

"Comfortline Mattress circular", entire circular, Hill–Rom, Inc., 700 State Road, 46 East, Batesville, IN, 1997.

*Primary Examiner*—Robert G. Santos
(74) *Attorney, Agent, or Firm*—Barnes & Thornburg

(57) ABSTRACT

A surface for a patient support or a part thereof includes an anti-shear liner, a cover, and a cushion layer. A method for minimizing shear on a patient's skin as the patient rests upon a patient support includes providing an anti-shear layer, providing a cover, and placing the anti-shear layer and cover on the support. The cover may have a surface integrity against fluid leakage which is maintained upon stretching of the cover. The anti-shear liner may be disposed between the cover and the cushion layer, permitting the cover to slip relative to the cushion layer. The cover may be stretchable in one direction more than in an orthogonal direction.

31 Claims, 6 Drawing Sheets

U.S. PATENT DOCUMENTS 5,960,496 A * 10/1999 Boyd ..... 5/740 X
6,049,927 A 4/2000 Thomas et al. ..... 5/632
6,115,861 A * 9/2000 Reeder et al. ..... 5/727
6,159,574 A * 12/2000 Landvik et al. ..... 5/953 X
6,199,231 B1 * 3/2001 Zafiroglu ..... 5/497
6,223,371 B1 * 5/2001 Antinori et al. ..... 5/727
6,256,821 B1 * 7/2001 Boyd ..... 5/727 X
6,269,504 B1 * 8/2001 Romano et al. ..... 5/727 X
6,272,701 B1 * 8/2001 Zafiroglu ..... 5/499
6,286,167 B1 * 9/2001 Stolpmann ..... 5/737
6,311,351 B1 * 11/2001 Murphy ..... 5/727

* cited by examiner

PATIENT SUPPORT SURFACE

BACKGROUND SUMMARY OF THE INVENTION

This invention relates to patient support surfaces and positioners and more particularly to pressure management and skin shear-reducing surfaces and positioners.

Care providers are well aware that patient support surfaces and positioners can play a significant role in the creation or prevention of pressure ulcers. Patients undergoing surgical procedures, medical procedures, or recovery from the same, have their entire body and/or portions of their body supported by patient support surfaces and positioners. Portions of the patient's skin may be subjected to very high pressures and shear forces exerted by the material underlining skin resulting in tissue loads that restrict blood flow to a particular area of the skin resulting in tissue damage or necrosis. This is a major cause of pressure ulcers.

The described invention reduces the risk of skin shear and decreases tissue load. The disclosed surfaces and positioners distribute the patient's weight more evenly across the surface to significantly decrease pressure on the body's bony prominences. The disclosed surfaces are designed to cradle the patient and reduce pressure on the bony prominences, thus reducing patient interface pressure. This facilitates effective distribution of the patient's tissue load evenly over the surface. This is accomplished in certain preferred embodiments by using a highly stretchable cover overlying the patient supporting surface of a cushion adapted to more evenly distribute the patient's weight. The cushion may be an air cushion, a foam pad, or a combination of foam pads having different densities and recovery ratings, an air impregnated gel, or any combination of these cushioning materials.

Decreasing interface pressure between the support surface and the patient does not necessarily reduce skin shear. Similarly, it is known that common gel overlays which significantly reduce skin shear can actually increase interface pressure. The present invention comprises an anti-shear liner or layer which combines the four-way stretch cover material with a friction-reducing and anti-shear layer.

A patient support surface or positioner according to the present invention includes an anti-shear liner, a cover, and a cushion layer. The anti-shear liner is disposed in selected areas between the cover and the cushion layer to allow the cover to slip in such selected areas relative to the cushion layer. The cover is preferably configured to be highly stretchable. The cover preferably may be a rubber-like material which is characterized by its stretchability in one direction being greater than its stretchability in an orthogonal direction. When the patient support is longitudinally extending with a foot end and a head end, a stretchable cover may be positioned on the support so that it is more stretchable in the longitudinal direction.

The cushion may be formed by a plurality of air cavities, a plurality of foam layers, gel material, or any combination thereof. The foam layers may be selected from a group of slow recovery foam, low density foam, high density foam, reduced density foam, medium density foam, and closed cell foam. The air cushion may include a plurality of sealed air bladders in combination with inflatable bladders. Foam layers may be used in different combinations in different areas of the support, to support different areas of the patient's body differently. Likewise sealed air bladders and inflatable air bladders maybe used in different combinations and in different areas of the surface, to support different parts of the patient's body differently. The anti-shear layer may be disposed under the entire patient supporting surface of the cover or under selected portions of the cover, depending upon the surface characteristics desired.

A process of distributing patient weight and minimizing shear on the patient's skin includes the steps of providing a cover, providing a cushion, and providing an anti-shear layer over selected portions of the cushion. The combination of the cover, anti-shear layer, and cushion, with the anti-shear layer disposed between the cover and the cushion, is placed on a patient support such as a surgery table, bed or stretcher. The anti-shear layer is preferably selectively positioned under the cover to provide an area having less resistance to cover stretching and movement relative to the cushion.

According to another aspect of the disclosed invention. A patient support includes air bladders made of anti-shear material and a stretchable cover placed over the air bladders.

According to still another aspect of the disclosed invention, a surface for a patient support or part thereof includes a series of inflatable air bladders made from anti-shear material which are disposed to provide a cushion under the patient with the highly stretchable cover over the air bladders. A viscoelastic foam layer may be disposed between the cover and the air bladder. At least one of the plurality of inflatable air bladders may be disposed within a permanently sealed and inflated bladder.

In some embodiments of the present invention a cover may not be highly stretchable as that term is hereinafter defined. Thus, in this specification and particularly in the claims, unless the cover is specified as "highly stretchable", it shall not be limited to such characteristics.

Additional features of the invention will become apparent to those skilled in the art upon consideration of the following detailed description of the preferred embodiment exemplifying the best mode of carrying out the invention as presently perceived.

BRIEF DESCRIPTION OF THE DRAWINGS

In describing the disclosed invention reference will be made to the following drawings in which.

DETAILED DESCRIPTION OF THE DRAWINGS

Patient support surfaces and positioners for distributing loads and minimizing the shear on a patient's skin according to the present invention preferably comprise a resilient cushion and a highly stretchable cover extending across the supporting surface of the cushion or positioner and an anti-shear layer disposed to permit the cover to slide freely with respect to the cushion on at least a portion of the patient support surface. For convenience herein, including in the claims, unless otherwise specified, the term "patient support surface" shall include a support surface such as abed, stretcher, or surgery table or a portion thereof or a positioner or pad used on or in connection with a bed, stretcher, or surgery table. The preferred highly stretchable cover and cushion cooperate to distribute the patient's weight more evenly across the surface to significantly decrease pressure on the body's bony prominences. The material forming the preferred highly stretchable cover and a friction reducing anti-shear layer allow the cover to slide with respect to the underlying cushion thereby reducing shear forces on the patient's skin. In illustrative embodiments, the highly stretchable cover is a rubber-like material such as a neoprene material, for example 1490 Dura neoprene which is available from RUBATEX Corporation, 5223 ValleyPark Drive, Roanoke, VA. 24019.

Figure 12:
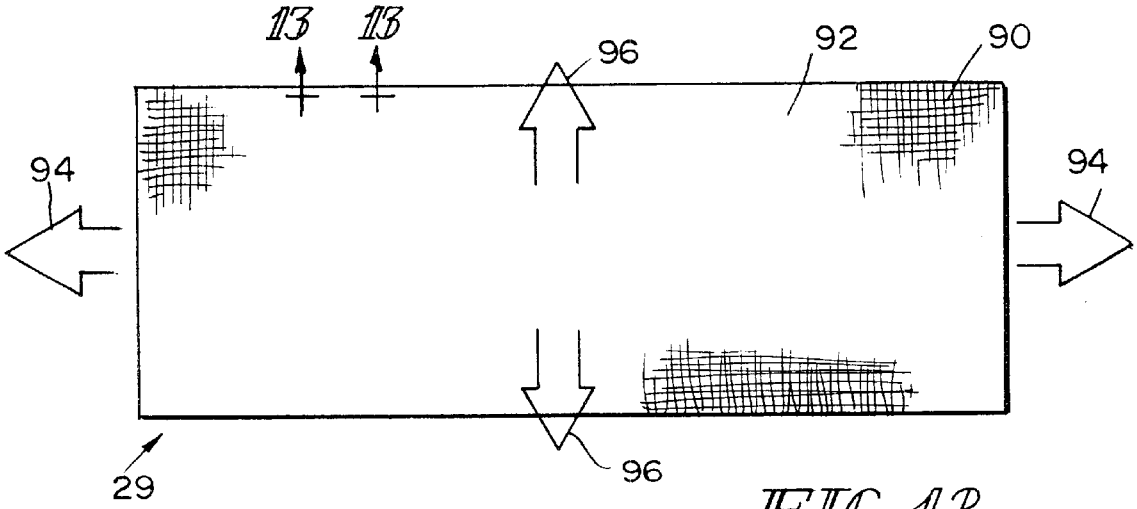
FIG. 12 is a plain view of a highly stretchable material used to form a stretchable cover.
Figure 13:
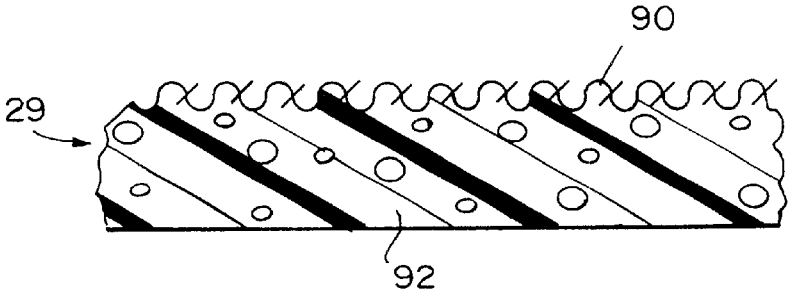
FIG. 13 is a sectional view taken along line 13—13 of FIG. 12 of the highly stretchable material.

As shown, for example, in FIG. 13, 1490 Dura neoprene includes a cloth material weave 90 bonded to a foam rubber base 92. Due to the orientation of the weave, 1490 Dura neoprene is stretchable from its unstressed configuration by 64% in one direction, shown by arrows 94 in FIG. 12, (referred to herein as its "stretch length 94" not to be confused with its actual length which is a function of its shape) and by 40% in an orthogonal direction, shown by arrow 96 in FIG. 12, (referred to herein as its "stretch width 96" not to be confused with its actual width which is a function of its shape).

Another example of highly stretchable material is PO 88 Penn-Nyla which is stretchable by 106% along its stretch length 94 and 40% along its stretch width 96. PO 88 Penn-Nyla is available from Penn-Nyla, Acton Road, Long Eaton, GB-Nottingham, NG10, 1FX, United Kingdom. While some sheet materials may be available which will stretch more than, for example, 120% or more in length and 60% or more in width, and return over time to their normal unstretched dimension, it is important for patient surfaces to have surface integrity against fluid leakage. The 1490 Dura neoprene from RUBATEX Corporation, and PO 88 Penn-Nyla materials are examples of materials which are able when stretched within their respective limits to have suitable integrity against fluid leakage. (The stretchability of a material may be determined by taking a strip which is 2" wide and 8" long and placing a four pound weight on the strip to measure its elongation and potential to return to its unstretched condition in a reasonable time.) The present invention, therefore, contemplates a highly stretchable material which will stretch substantially beyond the stretch capability of conventional patient support covers and still maintain its surface integrity against leakage of fluid. It is believed that highly stretchable material, as compared to conventional cover materials, will preferably stretch 20% or more in length and 8 to 10% or more in width, although materials which will stretch substantially more than conventional cover materials to reduce shear contact with the patient may be considered highly stretchable in accordance with the present invention. The preferred material will stretch an amount sufficient to reduce significantly the shear stress on the patient's skin.

It will be appreciated that a preferred material may stretch 60–106% in length and 40% in width and still maintain its surface integrity against fluid leakage. Preferred materials with less stretchability may be satisfactory.

As used herein, the term "highly stretchable" shall mean a sheet-like material which is suitable as a cover for a patient support and which is rubber-like to be stretchable to a greater extent than conventional patient surface cover materials. The term "highly stretchable" shall also include, as an example, a material which is stretchable 120% or more along its stretch length 94 and 60% or more along its stretch width 96 and still have surface integrity against fluid leakage suitable for a patient support surface. The term "highly stretchable" also means that, when stretched within its elastic limit, it will tend to return to its normal dimension when released, at least over time. The "highly stretchable" material is also preferably a four-way stretch material which is stretchable along a diagonal and is stretchable and compressible through its thickness.

The anti-shear layer of the present invention is a friction reducing layer disposed between the highly stretchable cover and portions of the cushion. The anti-shear layer permits the highly stretchable cover to slide with respect to portions of the underlying cushion. The anti-shear layer also permits the highly stretchable cover to stretch without the stretch being inhibited by the underlying cushion. In the illustrated embodiments, the anti-shear layer is polyethylene material, but may be any other suitable material with suitable surface properties, such as nylon or "parachute" material, to permit the highly stretchable layer to slide and stretch with respect to the underlying cushion.

Figure 1:
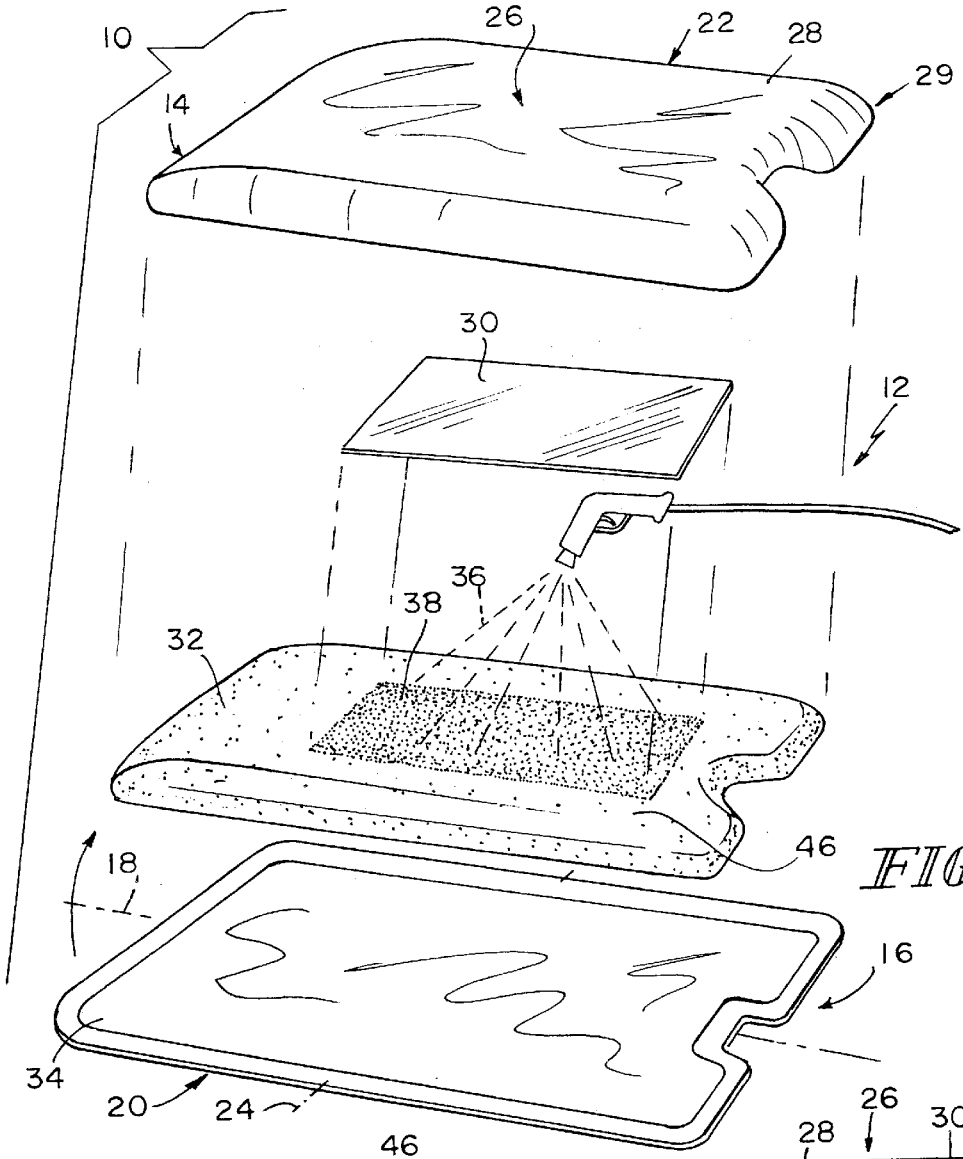
FIG. 1 is an exploded view of a first embodiment of a patient support in accordance with the present invention showing a cover over an anti-shear layer which is to be adhered to a cushion and a bottom coverlet.

Referring to FIG. 1, an exploded view of a foam cushion embodiment 12 of a patient support surface 10 is shown. Each embodiment of patient support 10 includes a head end 14 spaced apart from a foot end 16 in a longitudinal direction shown by longitudinal axis 18, a first side 20 and a second side 22 spaced apart in a lateral direction shown by lateral axis 24, and an upwardly facing patient supporting surface 26 shown illustratively in FIG. 1 as the upwardly facing surface disposed between head end 14, foot end 16, first side 20, and second side 22.

As shown, for example, in FIG. 1, foam cushion patient support surface 12 includes a cover 28 preferably, but not necessarily, formed from highly stretchable material 29, an anti-shear layer or liner 30, a cushion or cushion layer 32, and a bottom coverlet 34. In the illustrated embodiment of foam cushion patient support surface 12, anti-shear layer 30 has a surface area smaller than surface area of patient supporting surface 26. Glue 36 is sprayed in a central portion 38 of patient supporting surface 26 of cushion 32 in an area substantially equal to the area of the anti-shear layer 30. Anti-shear layer 30 is bonded to central portion 38 of cushion 32, as shown for example, in FIG. 2. Cover 28 is placed over combined cushion 32 and anti-shear layer 30 and is connected to bottom coverlet 34 by a seam 40 extending peripherally around sidewall 42 in a position spaced apart from patient supporting surface 26 and bottom surface 44 of patient support surface 10 as shown, for example, in FIG. 2.

Although illustrated as rectangular, anti-shear layer 30 and central portion 38 may have other shapes. For example, an hour glass-shaped anti-shear layer and central portion positioned so that the wider areas underlie the shoulders and hips of a patient on the support surface 10 are contemplated as being within the scope of the invention as presently perceived. Glue 36 may be applied over the entire central portion 38 or over any portion thereof sufficient to adhere or bond anti-shear layer 30 to central portion. Alternatively, glue 36 may be applied to anti-shear layer 30, or anti-shear layer 30 may be adhered to central portion 38 in any conventional manner.

Figure 2:
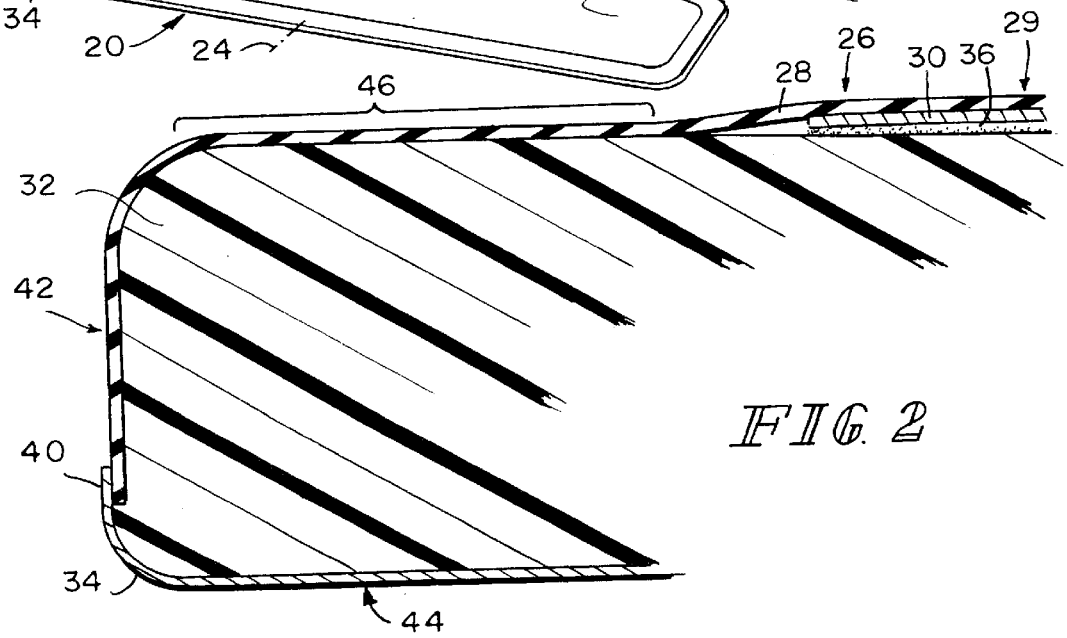
FIG. 2 is a sectional view of the support surface of FIG. 1 showing the cover disposed over the anti-shear layer adhered to the cushion in a central region of the patient supporting surface with the cover directly contacting the cushion along a side edge of the patient supporting surface, and also showing a seam coupling the cover to a bottom coverlet which is located along the side of the support surface.

As shown, for example, in FIGS. 1 and 2, cover 28 directly engages cushion 32 along sidewalls 42 and along peripheral portions 46 of patient supporting surface 26. Frictional engagement between cover 28 and cushion 32 helps to maintain cover 28 properly positioned with respect to patient support 10. Without this frictional engagement, cover 28 can rotate around foam cushion 32, or bunch up at one end when made from highly stretchable material 29, when the support on which patient support surface 10 is placed is inclined. Patient movement on support surface 26 might also induce cover 28 to bunch or gather when cover is made from highly stretchable material 29. In central portion 38 of patient support surface 26 cover 28 engages anti-shear layer 30 which is disposed over cushion 32. In this area, cover 28 is free to slide, and to stretch when cover is made from highly stretchable material 29, without being inhibited by frictional forces. Central portion 38 is the area of support surface 26 on which patient is likely to be supported.

In the illustrated embodiment, cover 28 is preferably made from highly stretchable material 29 such as 1490 Dura Neoprene as previously disclosed. Bottom coverlet 34 is made from Lectrolite light material which stretches very little. Seam 40 between cover 28 and bottom coverlet 34 is located on sidewall 42 away from where fluids collect and pool in a healthcare environment. This facilitates maintaining patient support surface 10 in a properly sterile state.

Figure 3:
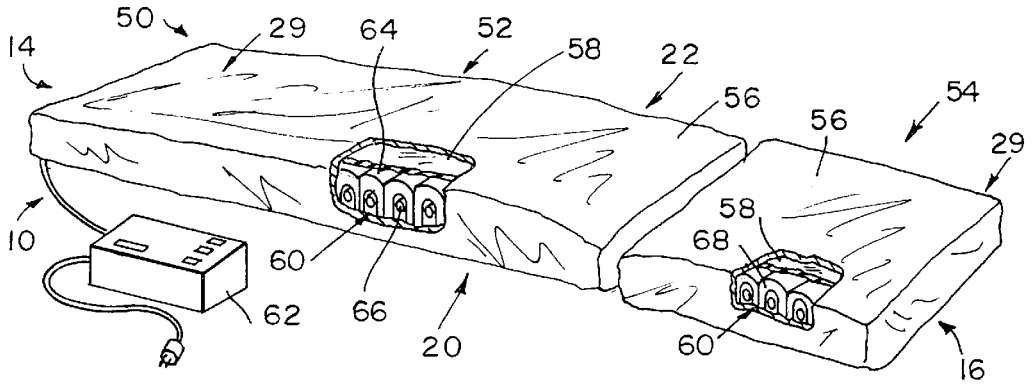
FIG. 3 is a perspective view of another embodiment of the patient support of the present invention showing a torso pad having a cover made entirely of highly stretchable material under which a viscoelastic foam layer lies on top of a plurality of sealed arching air bladders having inflatable air bladders disposed therein which are inflated by the pressure controller coupled to the torso pad, and a foot pad having a cover made entirely of highly stretchable material, a viscoelastic foam layer disposed between the patient supporting surface of the foot pad, and plurality of inflatable arching air bladders.

Referring to FIG. 3, an air mattress cushion embodiment 50 of patient support surface 10 is illustrated. Air mattress cushion patient support surface 50 includes a torso pad 52 and a foot pad 54. Torso pad 52 and foot pad 54 each include a unitary highly stretchable cover 56, a viscoelastic foam layer 58, and an air mattress cushion 60 with air bladders 64, 66, 68 formed from anti-shear material. An inflation controller 62 controls the pressure in inflatable bladders in torso pad 52 and foot pad 54 by inflating and deflating the bladders. Air mattress cushion 60 of torso pad 52 includes a plurality of longitudinally spaced, laterally extending sealed arching upper cells 64 which are filled to a desired pressure with air and sealed by the manufacturer. Extending laterally within an opening of each sealed arching upper cell 64 is an inflatable inner cell 66 coupled to inflation controller 62. Air mattress cushion 60 of foot pad 54 includes a plurality of laterally extending inflatable arching cells 68 coupled to inflation controller 62. Illustrated air mattress cushion 60 is a Carital Air-float system available from Carital Ltd., P.O. Box 1 70, 04300 Tuusula, Finland. It should be understood that other air mattress systems, are within the teaching of the scope of this disclosure.

Illustratively, viscoelastic foam layer 58 is ½" thick viscoelastic foam. Viscoelastic foam is stretchable, and will stretch along with highly stretchable cover 56. Therefore, highly stretchable cover 56 and viscoelastic foam layer 58 may stretch and slide freely relative to the anti-shear material forming arched cells 64, 68. Inflation controller 62 dynamically alters the pressure of inflatable bladder 66, and inflatable bladders 68 to optimize patient interface pressure. These bladders will not become permanently compressed or become permanently deformed over time as many static surfaces can.

Figure 4:
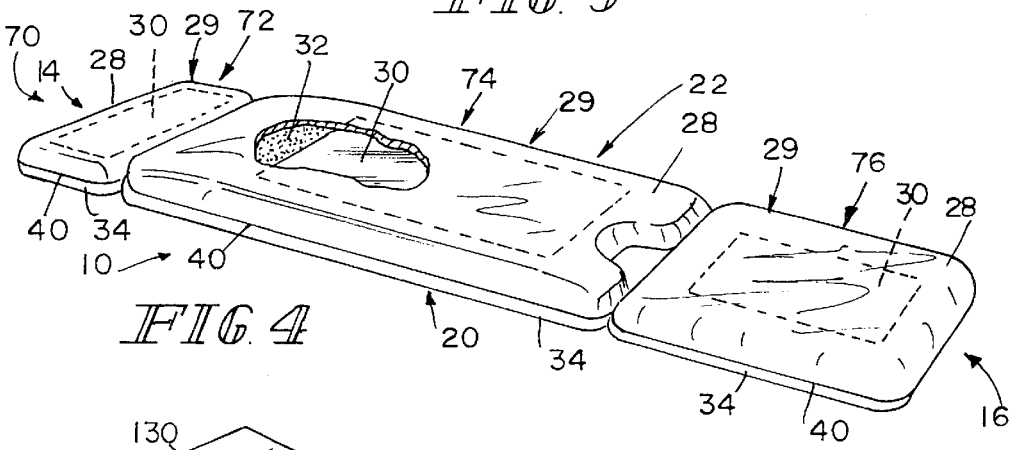
FIG. 4 is a perspective view of a foam cushion embodiment of a patient support according to the present invention showing a head pad, a torso pad, and a foot pad, each pad including a foam cushion and anti-shear layer overlying a portion of the patient supporting surface of the foam cushion, a cover extending over the patient supporting surface which is coupled to a bottom coverlet by a seam extending along the side of the support.

Referring to FIG. 4 there is shown a multi-segmented foam cushion embodiment 70 of patient support surface 10. Multi-segmented foam cushion patient support surface 70 includes a head pad 72, a torso pad 74, and a foot pad 76. Each pad 72, 74, 76 includes a cover 28 preferably made from highly stretchable material 29, an anti-shear layer 30, a cushion 32, and a bottom coverlet 34. In each of pad 72, 74, 76, anti-shear layer 30 is adhered by glue 36 to at least a central portion 38 of cushion 32 as described earlier with regard to foam cushion patient support surface 12. Likewise, cover 28 is joined by a seam 40 peripherally extending around sidewall 42 of each of pads 72, 74, 76 to bottom coverlet 34, made for example from Lectrolite material. Several different embodiments of cushion 32 are used in multi-segmented foam cushion embodiment 70 as described hereafter.

Figure 5:
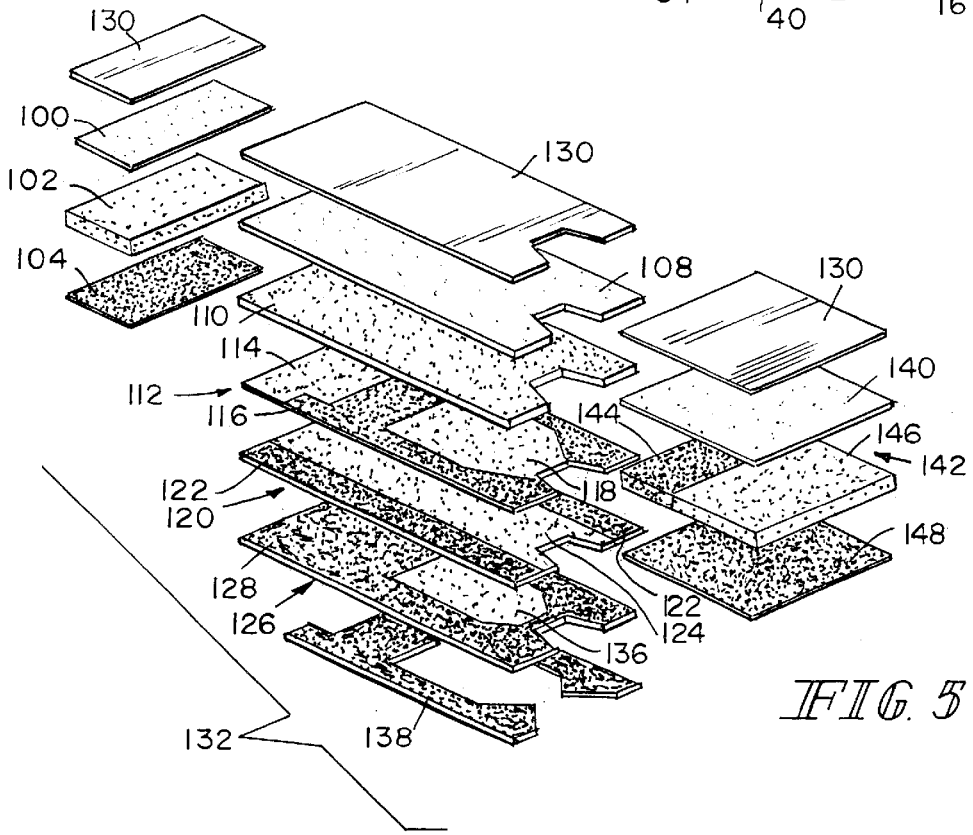
FIG. 5 is an exploded view of one embodiment of the anti-shear layer and cushion for use in the multi-segmented foam cushion of FIG. 4, showing the cushion formed from multiple sections of slow recovery foam, low density foam, and high density foam.

Referring to FIG. 5, there is shown an exploded view of a first embodiment of a segmented multi-layer cushion 132 and anti-shear layers 130 for use in a multi-segmented foam cushion patient support surface 70. The cushion segment 132 for use in head pad 72 includes an upper slow recovery foam layer 100, a medial low density foam layer 102, and a bottom high density foam layer 104.

Throughout the application the terms slow recovery foam, low density foam, high density foam, reduced density foam, and closed cell foam will be used. Each of these foams is formed from a foam rubber material such as urethane foam, although any suitable material providing similar support and firmness characteristics to those described below for the particular foam can be used without exceeding the scope of the invention as presently perceived. The firmness and support characteristics provided by each of these types of foam depend in part upon indentation load deflection (ILD) of the foam from which each layer is made. The ILD is a well-known industry accepted index indicating the "firmness" of materials such as urethane foam and other foam rubber materials. The ILD indicates the amount of deflection exhibited by a block of foam when subjected to a specified force distributed over a specified area of foam.

It is within the scope of the invention as presently perceived to provide foam cushion 32 wherein each segment or layer has the same ILD or to provide foam cushion 32 wherein the ILD of at least one layer is different from the ILD of at least one other layer.

In referring to layers or zones described as slow recovery foam, the layer or zone is a foam material that easily conforms to the contour of the patient when weight is applied and slowly returns to its uncompressed state after the weight is removed. Slow recovery foam is typically not characterized by its ILD. Slow recovery foam having the characteristics described herein is available from EAR Specialty Composites, 7911 Zionsville Road, Indianapolis, Ind. 46268 as CF-40 Foam (Sofcare).

When referring to a foam section or zone as formed from low density foam, the foam portion or zone primarily facilitates pressure reduction and provides very little support. Such foam is typically used in the heel portion, scapula portion, and seat portion of a patient support. Low density foam having the characteristics described herein is available from Keystone Foam, P.O. Box 355, Loyalhanna, Pa. 15661 as part no. 1820 foam which has a pounds per cubic foot rating of about 18 and an ILD of about 20.

When referring to a section or zone as being made from high density foam, the foam primarily serves a support function and contributes, when used alone, only incidentally to pressure reduction, but, when used in conjunction with overlying, underlying, or adjacent lower density foam, substantially improves pressure reduction. High density foam having the characteristics described herein is available from Keystone Foam, P.O. Box 355, Loyalhanna, Pa. 15661 as part no. 2860 foam which has a pounds per cubic foot rating of about 28 and an ILD of about 60.

When referring to a section or zone as being made from reduced density foam, the foam contributes primarily to pressure reduction while providing additional firmness and support characteristics to areas of the cushion. Reduced density foam is typically used in cushion areas supporting the shoulders in conjunction with slow recovery foam. Reduce density foam having the characteristics described herein is available Keystone Foam, P.O. Box 355, Loyalhanna, Pa. 15661 as part no. 1845 foam which has a pounds per cubic foot rating of about 18 and an ILD of about 45.

When referring to a section or zone as being formed from medium density foam, the foam material contributes both to support and pressure reduction. Medium density foam having the characteristics described herein is available from Keystone Foam, P.O. Box 355, Loyalhanna, Pa. 15661 as part no. 1845 foam which has a pounds per cubic foot rating of about 18 and an ILD of about 45.

When referring to a section or zone as being made from closed cell foam, the portion or section is made from a foam that contributes almost exclusively to support. Closed cell foam is typically used as an underlayment in layered cushions to prevent bottoming out of the patient against an underlying rigid surface of a support such as an OR table. Closed cell foam having the characteristics described herein is available from RUBATEX Corporation, 5223 ValleyPark Drive, Roanoke, Va. 24019 as part no. R-341 Nytril.

While slow recovery, high density, low density, medium density, reduced density, and closed cell foam have been specifically identified by vendor and part number, other foams having characteristics similar to the specifically identified foams may be used in a patient support surface within the teachings of the invention. Other examples of ILDs for foam cushions adapted to provide adequate support and pressure reduction for various areas of the body are disclosed in U.S. Pat. No. 5,802,646 to Stolpmann et al. which is incorporated herein by reference.

Foam cushion 132 of head pad 72 is formed by bonding lower high density foam layer 104 to middle low density foam layer 102 and then bonding upper slow recovery foam layer 100 to middle low density foam layer 102. Anti-shear layer 130 is then bonded to upper slow recovery foam layer 100 and the entire unit is received within cover 28 and bottom coverlet 34 joined together by seam 40 extending around sidewall 42 of head pad 72, in the same manner as described with reference to FIGS. 1 and 2 above.

Foam cushion 132 of torso pad 74 includes an upper slow recovery foam layer 108, an intermediate low density foam layer 110, an upper intermediate multi-zone layer 112, a middle intermediate multi-zone layer 120, a lower intermediate multi-zone layer 126, and a lower high density cradle and lumbar bolster layer 138. Upper intermediate multi-zone layer 112 includes a low density foam scapula/shoulder zone 114, a high density foam cradle and lumbar bolster zone 116, and a low density foam sacral/trochanter zone 118. Middle intermediate multi-zone layer 120 includes a high density foam cradle zone 122 and a low density foam vertebral zone 124. Lower intermediate multi-zone layer 126 includes a high density foam zone 128 and a low density foam sacral/trochanter zone 136.

Lower high density cradle and lumbar bolster layer 138 is bonded to the bottom of lower intermediate multi-zone layer 126. The top of lower intermediate multi-zone layer 126 is bonded to the bottom of middle intermediate multi-zone layer 120. The top of middle intermediate multi-zone layer 120 is bonded to the bottom of upper intermediate multi-zone layer 112. The top of upper intermediate multi-zone layer 112 is bonded to the bottom of intermediate low density foam layer 110. The top of intermediate low density foam layer 110 is bonded to the bottom of upper slow recovery foam layer 108. Thus foam cushion 132 of torso pad 74 includes the bonded assembly of upper slow recovery foam layer 108, intermediate low density foam layer 110, upper intermediate multi-zone layer 112, middle intermediate multi-zone layer 120, lower intermediate multi-zone layer 126, and lower high density foam cradle and lumbar bolster layer 138. Anti-shear layer 130 is glued to the top of upper slow recovery foam layer 108 of foam cushion 132 and the entire assembly is enclosed by cover 28 and bottom coverlet 34 which are joined together by seam 40 extending peripherally around sidewall 42 of torso pad 74, in the same manner as described with reference to FIGS. 1 and 2 above.

Foam cushion 132 and anti-shear layer 130 of foot pad 76 are shown to the right in FIG. 5. Foam cushion 132 of foot pad 76 includes an upper slow recovery foam layer 140, an intermediate multi-zone layer 142, and a lower high density foam layer 148. Intermediate multi-zone layer 142 includes a high density foam zone 144 and a low density foam heel zone 146. Lower high density foam layer 148 is bonded to the bottom of intermediate multi-zone layer 142. The top of intermediate multi-zone layer is bonded to the bottom of upper slow recovery foam layer 140. Thus foam cushion 132 of foot pad 76 includes the bonded upper slow recovery foam layer 140, intermediate multi-zone layer 142, and lower high density foam layer 148. Anti-shear layer 130 is glued to the top of upper slow recovery foam layer 140 of foam cushion 132 and the entire assembly is enclosed in cover 28 and bottom coverlet 34 which are joined together by a seam 40 extending peripherally around the sidewall 42 of foot pad 76, in the same manner as described with reference to FIGS. 1 and 2 above.

Figure 6:
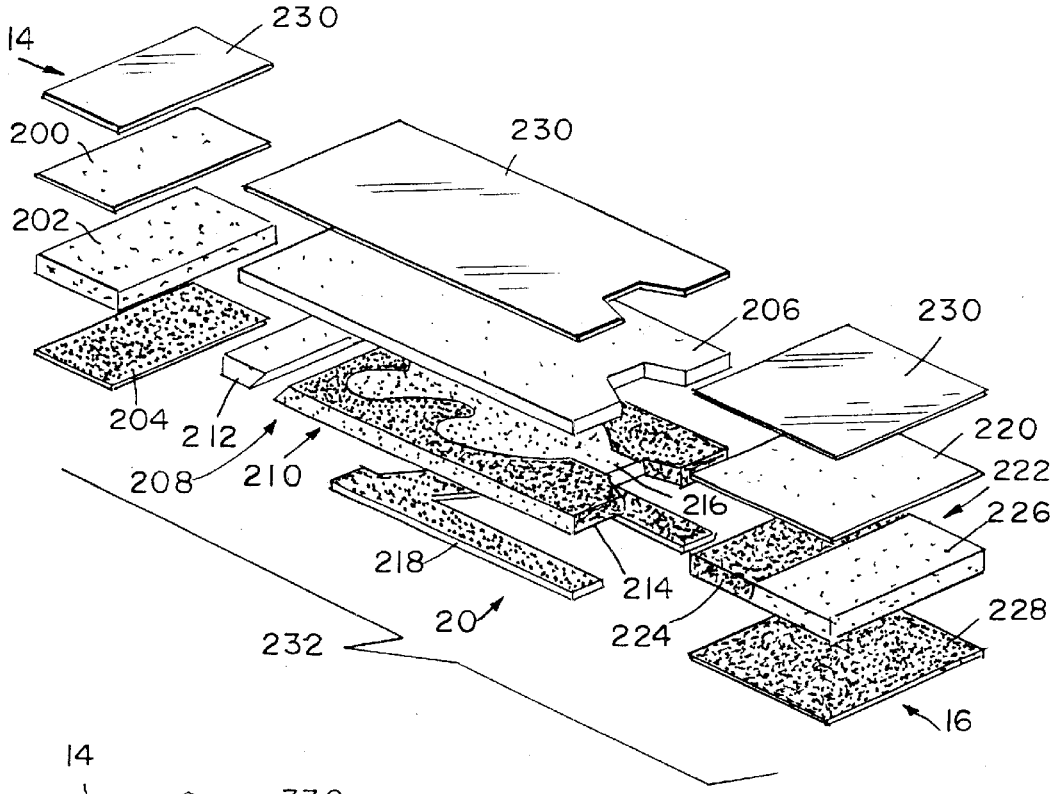
FIG. 6 is an exploded view of an embodiment of the anti-shear layer and cushion for use in the multi-segmented foam cushion of FIG. 4 showing the cushion including several sections made from slow recovery foam, low density foam, high density foam, and reduced density foam.

Referring to FIG. 6, there is shown an exploded view of a second embodiment of an anti-shear layer 230 and foam cushion 232 for use with multi-segmented foam cushion patient support system 70 of FIG. 4. Foam cushion 232 of head pad 72 is formed by bonding lower high density foam layer 204 to middle low density foam layer 202 and then bonding upper slow recovery foam layer 200 to middle low density foam layer 202. Anti-shear layer 230 is then bonded to upper slow recovery foam layer 200 and the entire unit is received within cover 28 and bottom coverlet 34 joined together by seam 40 extending around sidewall 42 of head pad 72, in the same manner as described with reference to FIGS. 1 and 2 above.

The anti-shear layer 230 and foam cushion 232 of torso pad 74 are shown as the middle sections in FIG. 6. Foam cushion 232 of torso pad 74 includes upper slow recovery foam layer 206, intermediate multi-portion layer 208, and lower high density foam cradle and lumbar bolster layer 218. Intermediate multi-portion layer 208 includes multi-zone portion 210 and reduced density foam lateral shoulder portion 212, as shown, for example, in FIG. 6. Multi-zone portion 210 includes high density foam lumbar bolster zone 214 and low density foam sacral/trochanter zone 216. Foam cushion 232 of torso pad 74 is formed by bonding the top of lower high density foam cradle and lumbar bolster layer 218 to the bottom of multi-zone portion 210 of intermediate multi-portion layer 208, and bonding the tops of multi-zone portion 210 and reduced density foam lateral shoulder portion 212 of intermediate multi-portion layer 208 to the bottom of upper slow recover foam layer 206. Anti-shear layer 230 is glued to the top of upper slow recovery foam layer 206 of foam cushion 232 to form an assembly. This assembly is received in cover 28 and bottom coverlet 34 which are joined together by a seam 40 extending peripherally around sidewall 42 of torso pad 74, in the same manner as described with reference to FIGS. 1 and 2 above.

Anti-shear layer 230 and foam cushion 232 of foot pad 76 of multi-segmented foam cushion patient support surface 70 are shown to the right in FIG. 6. Foam cushion 232 of foot pad 76 includes upper slow recovery foam layer 220, intermediate multi-zone layer 222 and lower high density foam layer 228. Intermediate multi-zone layer 222 includes high density foam zone 224 and low density foam heel zone 226. Foam cushion 232 of foot pad 76 is formed by bonding the top of lower high density foam layer 228 to the bottom of intermediate multi-zone layer 222 and the top of intermediate multi-zone layer 222 to the bottom of upper slow recovery foam layer 220. Anti-shear layer 230 is glued to the top of upper slow recovery foam layer 220 of foam cushion 232 of foot pad 76 to form an assembly. This assembly is received in cover 28 and bottom coverlet 34 which are joined together by a seam 40 extending peripherally around sidewall 42 of foot pad 76, in the manner described above with regard to FIGS. 1 and 2.

Figure 7:
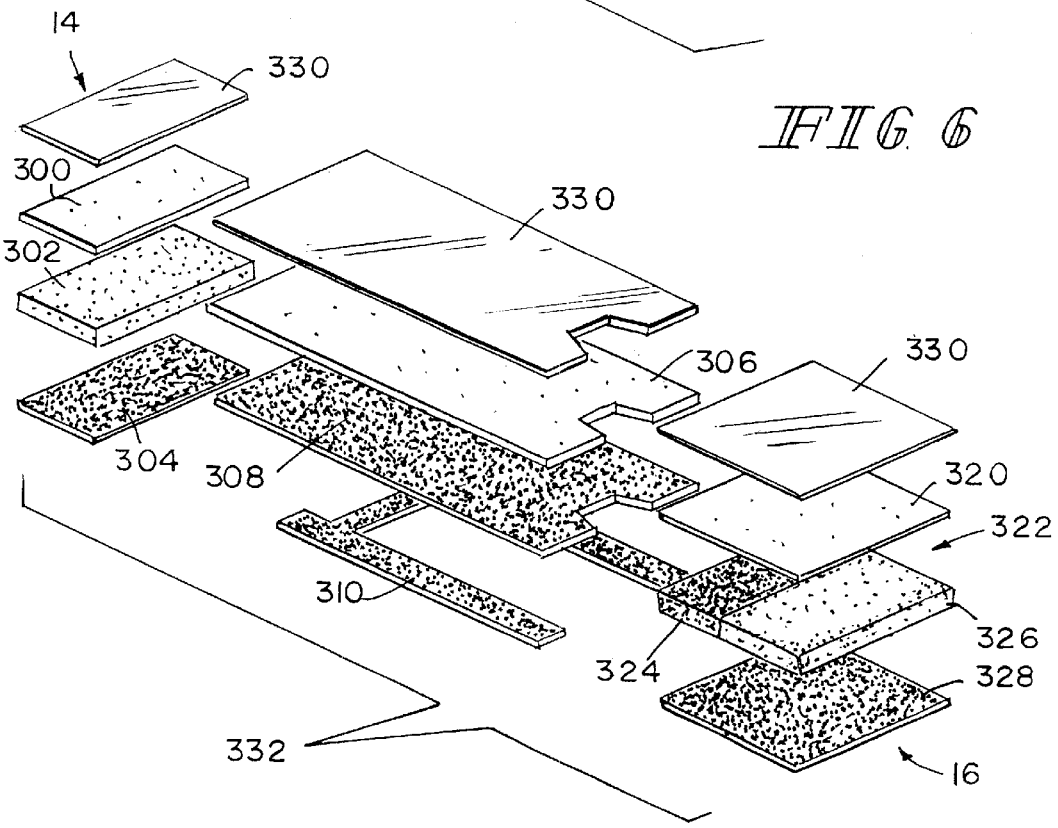
FIG. 7 is an exploded view of an embodiment of the anti-shear layer and foam cushion for use in the multi-segmented foam cushion of FIG. 4, showing the foam cushion made from segments of slow recovery foam, low density foam, and high density foam.

The third embodiment of a foam cushion 332 and anti-shear layer 330 for use in multi-segmented foam cushion patient support surface 70 is shown in FIG. 7. Foam cushion 132 of head pad 72 is formed by bonding lower high density foam layer 304 to middle low density foam layer 302 and then bonding upper slow recovery foam layer 300 to middle low density foam layer 302. Anti-shear layer 130 is then bonded to upper slow recovery foam layer 300 and the entire unit is received within cover 28 and bottom coverlet 34 joined together by seam 40 extending around sidewall 42 of head pad 72, in the same manner as described with reference to FIGS. 1 and 2 above.

Foam cushion 332 and anti-shear layer 330 for torso pad 74 is shown in the middle of FIG. 7. Foam cushion 332 for torso pad 74 includes upper slow recovery foam layer 306, intermediate high density foam layer 308, and high density foam cradle and lumbar bolster layer 310. Foam cushion 332 for torso pad 74 is formed by bonding the top of high density foam cradle and lumbar bolster layer to the bottom of intermediate high density foam layer 308 and the top of intermediate high density foam layer 308 to the bottom of upper slow recovery foam layer 306 to form an assembly. This assembly is received in cover 28 and bottom coverlet 34 which are joined together by a seam 40 extending peripherally around sidewall 42 of torso pad 74, in the same manner as described with reference to FIGS. 1 and 2 above.

Anti-shear layer 330 and foam cushion 332 of foot pad 76 of multi-segmented foam cushion patient support surface 70 is shown to the right in FIG. 6. Foam cushion 332 of foot pad 76 includes upper slow recovery foam layer 320, intermediate multi-zone layer 322, and lower high density foam layer 328. Intermediate multi-zone layer 322 includes high density foam zone 324 and low density foam heel zone 326. Foam cushion 332 of foot pad 76 is formed by bonding the top of lower high density foam layer 328 to the bottom of intermediate multi-zone layer 322 and the top of intermediate multi-zone layer 322 to the bottom of upper slow recovery foam layer 320. Anti-shear layer 330 is glued to the top of upper slow recovery foam layer 320 of foam cushion 332 of foot pad 76 to form an assembly. This assembly is received in cover 28 and bottom coverlet 34 which are joined together by a seam 40 extending peripherally around sidewall 42 of foot pad 76, in the same manner as described with reference to FIGS. 1 and 2 above.

Figure 8:
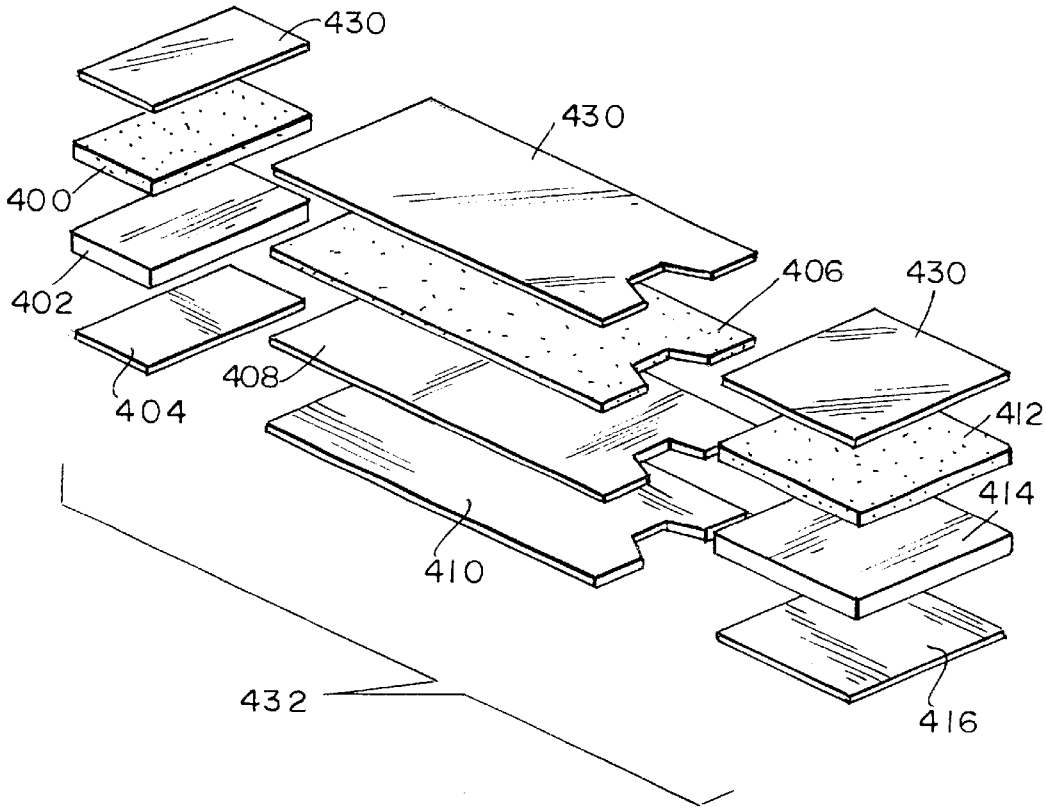
FIG. 8 is an exploded view of an embodiment of the anti-shear layer and foam cushion of FIG. 4, showing the foam cushion made of segments of slow recovery foam, medium density foam, and closed cell foam.

A fourth embodiment of foam cushion 432 and anti-shear layer 430 for use in multi-segmented foam cushion patient support surface 70 is shown in FIG. 8.

Foam cushion 432 and anti-shear layer 430 for head pad 72 are shown to the left in FIG. 8. Foam cushion 432 for head pad 72 includes upper slow recovery foam layer 400, intermediate medium density foam layer 402, and lower closed cell foam layer 404. Foam cushion 432 for head pad 72 is formed by bonding top of lower closed cell foam layer 404 to the bottom of intermediate medium density foam layer 402 and bonding the top of intermediate density foam layer 402 to the bottom of slow recovery foam layer 400. Anti-shear layer 430 is bonded to the top of slow recovery foam layer 400 to form an assembly. This assembly is received in cover 28 and bottom coverlet 34 which are joined together by a seam 40 extending peripherally around sidewall 42 of head pad 72, in the same manner as described with reference to FIGS. 1 and 2 above.

Foam cushion 432 and anti-shear layer 430 of torso pad 74 are shown in the middle of FIG. 8. Foam cushion 432 of torso pad 74 includes an upper slow recovery foam layer 406, an intermediate medium density form layer 408 and a lower closed cell foam layer 410. Foam cushion 432 of torso pad 74 is formed by bonding the top of closed cell foam layer 410 to the bottom of intermediate medium density form layer 408 and bonding the top of intermediate medium density form layer 408 to the bottom of upper slow recovery foam layer 406. Anti-shear layer 430 is bonded to the top of upper slow recovery foam layer 406 of foam cushion 432 to form an assembly. This assembly is received in cover 28 and bottom coverlet 34 which are joined together by a seam 40 extending peripherally around sidewall 42 of torso pad 74, in the manner described above with regard to FIGS. 1 and 2.

Foam cushion 432 and anti-shear layer 430 of foot pad 76 of multi-segmented foam cushion patient support surface 70 are shown to the right in FIG. 8. Foam cushion 432 of foot pad 76 includes an upper slow recovery foam layer 412, an intermediate medium density foam layer 414, and a lower closed cell foam layer 416. Foam cushion 432 of foot pad 76 is formed by bonding the top of lower closed cell foam layer 416 to the bottom of intermediate medium density foam layer 414 and bonding the top of intermediate medium density foam layer 414 to the bottom of slow recovery foam layer 412. Anti-shear layer 430 is glued to the top of upper slow recovery foam layer 412 to form an assembly. This assembly is received in cover 28 and bottom coverlet 34 which are joined together by a seam 40 extending peripherally around sidewall 42 of foot pad 76, in the manner disclosed above with regard to FIGS. 1 and 2.

Each embodiment of cushion 132, 232, 332, 432 for multi-segmented foam cushion patient support surface 70 is described as being formed by bonding various layers and zones together. Nevertheless, it is within the teaching of the present invention, for the layers and zones to be positioned relative to each other without bonding the layers and zones together. Those skilled in the art will recognize that other arrangements of cushioning elements, such as sealed and inflatable air bladders, foam pads, air impregnated gels, or any combination of these or other cushioning elements, are within the teachings of the invention.

In each of the embodiments described above of patient support surfaces 10, 50 and 70, the surface includes a longitudinal axis 18 extending between head end 14 and foot end 16 and a lateral axis 24 extending between first side 30 and second side 22. Unitary highly stretchable cover 56 and the preferred embodiment of cover 28 are formed from a highly stretchable material 29 such as 1490 Dura Neoprene which is stretchable along its stretch length 94 by 64% and orthogonally along its stretch width 96 by 40% (as the terms "stretch length" and "stretch width" are defined above). The 1490 Dura Neoprene highly stretchable material 29 is formed into cover 28 and unitary highly stretchable cover 56 so that its stretch length 94 lies along or parallel to longitudinal axis 18 and its stretch width 96 lies along or parallel to lateral axis 24. Other highly stretchable materials 29 which may be used to form covers 28, 56 are similarly oriented with respect to longitudinal axis 18 and lateral axis 24. While in the preferred embodiment the highly stretchable material 29 is oriented in cover 28, 56 so that its stretch length 94 is parallel to longitudinal axis 18 of surface 10, 50, 70 and its stretch width 96 is oriented parallel to lateral axis 24 of surface 10, 50, 70, other orientations of highly stretchable material 29 are within the teachings of this invention.

Figure 9:
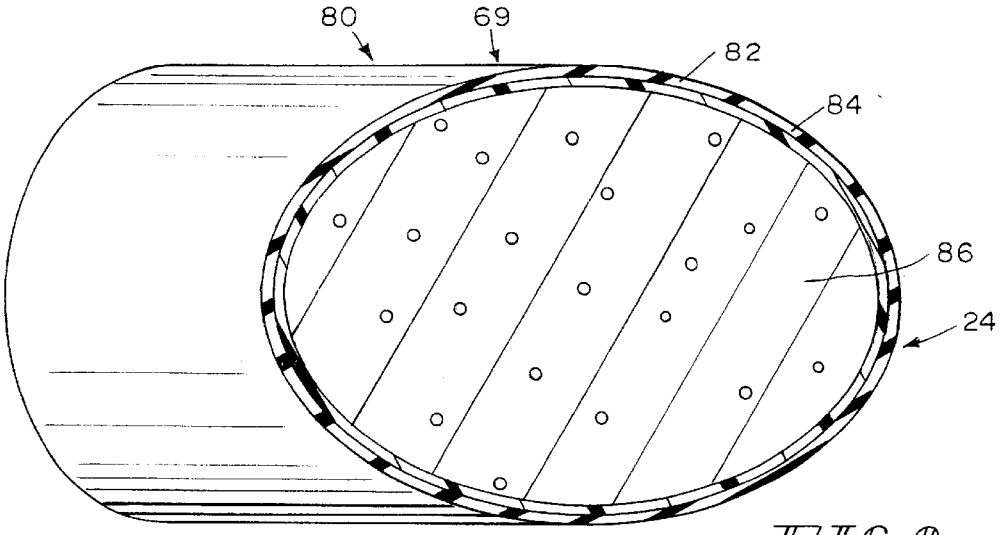
FIG. 9 is a sectional view of a positioner according to the present invention showing a highly stretchable cover enclosing an anti-shear layer enclosing a gel cushion.

FIG. 9 discloses a sectional view of a positioner 80 with a highly stretchable cover 82 in accordance with the present invention. While the illustrated positioner 80 is a chest roll, other positioners and surfaces such as head donuts, horseshoes, arm boards, heel protectors, or "sandbag positioners" are within the teachings of the present disclosure. In the illustrated chest roll positioner 80, a unitary highly stretchable cover 82 forms a complete enclosure around an anti-shear layer 84 which forms a complete enclosure around a gel cushion 86. Highly stretchable cover 82 when subjected to loads and shears by a patient is able to slide and stretch along anti-shear layer 84 without being inhibited by gel cushion 86. While patient support 10 and 70 disclose an anti-shear layer positioned only over portions of, or the entire, patient supporting surface 69, it is within the teaching of the invention for the entire foam cushion 32, 132, 232, 332, 432 to be completely enclosed in an anti-shear layer in the same manner as positioner 80.

Figure 10:
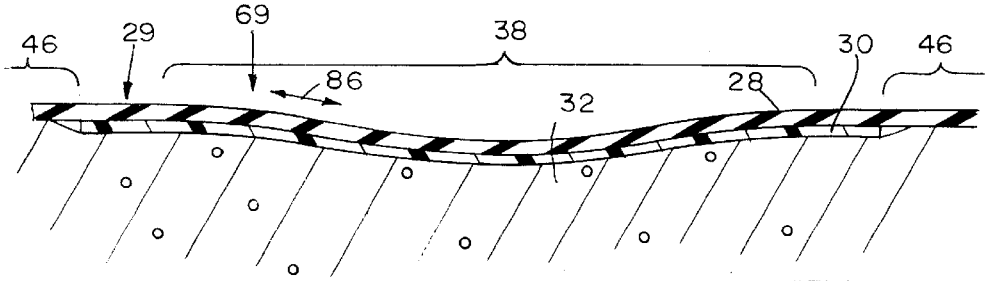
FIG. 10 is a partial sectional view of a support surface in accordance with the present invention slightly depressed under a load (not shown) showing a highly stretchable cover partially stretched to conform to the depression in the cushion.
Figure 11:
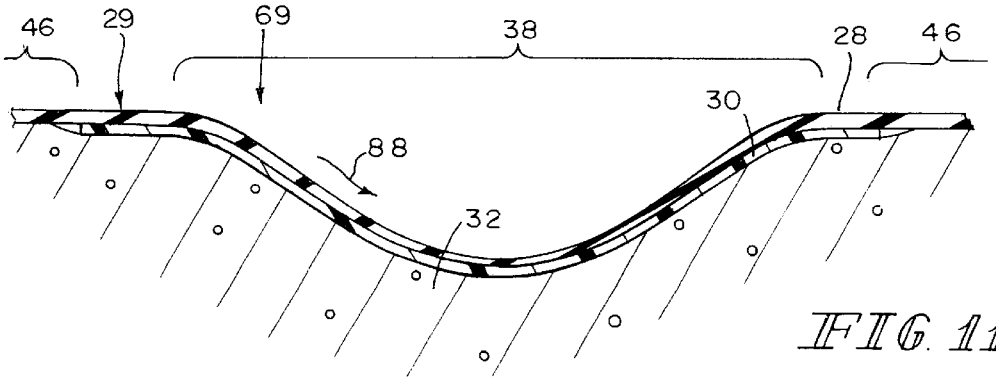
FIG. 11 is a sectional view similar to FIG. 10 showing the surface subjected to a heavier load (not shown)

As illustrated, anti-shear layers 130, 230, 330, 430 cover the entire patient supporting surface of foam cushions 132, 232, 332, 432. However, as shown in FIGS. 1, 2, and 4, it is within the teaching of the invention to have an anti-shear layer placed between cover 28 and foam cushion 32 in only a portion of the patient supporting surface 26. FIGS. 10 and 11 show one advantage that is obtained by leaving peripheral portions 46 of cushion 32 in engagement with cover 28. As a load (not shown) is placed on patient supporting surface 69, cover 28 in the area of the load (shown by the depression) stretches, when cover 28 is made from highly stretchable material 29 (as shown by the increased spacing between the cross hatches) and narrows (as shown by the narrowing of the width between the surface lines). The central portion 38 of cover 28 is free to slide in the direction of double headed arrow 86 over anti-shear layer 30 as shown in FIG. 10. Friction between cover 28 and foam cushion 32 in peripheral portions 46 of patient supporting surface 69 prohibits cover 28 from slipping, and stretching when cover 28 is made from highly stretchable material 29, in peripheral portions 46 (as shown by the uniform thickness of the surface lines and the uniform spacing ofcross hatchings of cover 28).

As an even greater weight is applied, as shown, for example, in FIG. 11, the central portion 38 of cover 28 stretches even further (as shown by the increased spacing between cross hatches) in the area of the higher pressure and continues to slide in the direction of arrow 88 relative to anti-shear layer 30 (as shown by the alteration of the location of cross hatches between FIGS. 10 and 11). Nevertheless the highly stretchable cover in peripheral portions 46 continues to remain substantially unstretched (as shown by the uniform spacing of the cross hatchings) and in the same location as before (as shown by the uniform location of the cross hatchings in FIGS. 10 and 11). This prevents highly stretchable material 29 from bunching up at one end or edge of the surface when the patient support is inclined during a surgical procedure or recovery.

It will be appreciated that, in some embodiments of the present invention, a suitable and novel patient support surface 10 may be provided which does not have a cover made of highly stretchable material 29 even though its skin shear protection characteristics may be further enhanced with a cover made form highly stretchable material 29.

Although the invention has been described in detail with reference to certain preferred embodiments, additional variations and modifications exist within the scope and spirit of the invention as described and defined in the following claims.

What is claimed is:

1. A surface for a patient support or a part thereof, the surface comprising:

an anti-shear liner, a cover including a highly stretchable upwardly-facing patient-supporting surface having a surface integrity against fluid leakage which is maintained upon stretching of the patient-supporting surface, and a cushion layer including an upwardly-facing patient-supporting surface, the anti-shear liner being disposed between the patient-supporting surfaces of the cover and the cushion layer, whereby the cover can slip relative to the cushion layer.

2. The surface of claim 1 in which the anti-shear liner is disposed over a portion of the cushion layer to leave other portions of the cushion layer in direct contact with the cover, whereby the surface has portions with different shear characteristics.

3. The surface of claim 1 in which the cushion layer comprises a gel pad.

4. The surface of claim 1 wherein the anti-shear liner is adhered to the cushion layer.

5. The surface of claim 4 wherein glue adheres the anti-shear liner to the cushion layer.

6. A surface for a patient support or a part thereof, the surface comprising:

a cover having an upwardly-facing patient-supporting surface characterized by its stretchability in one direction being greater than its stretchability in an orthogonal direction.

a cushion layer having an upwardly-facing patient-supporting surface, and an anti-shear liner disposed between the upwardly-facing patient-supporting surfaces of the cover and the cushion layer, whereby the cover can slip relative to the cushion layer.

7. The surface of claim 6, wherein the patient support is longitudinally extending between a head end and a foot end, and the cover is adapted for placement upon the support so that the upwardly-facing patient-supporting surface of the cover is more stretchable in the longitudinal direction.

8. The surface of claim 6 wherein the cushion layer includes a foam cushion.

9. The surface of claim 8 wherein the foam cushion includes a plurality of foam layers formed from material selected from the group of slow recovery foam, high density foam, low density foam, medium density foam, reduced density foam, and closed cell foam.

10. The surface of claim 9 wherein a foam layer nearest the highly stretchable cover is formed from slow recovery foam material.

11. The surface of claim 10 wherein a foam layer farthest from the highly stretchable cover is formed from high density foam.

12. The surface of claim 6 wherein the anti-shear liner is formed into air cavities to provide the cushion, the cover includes a foam base and a rubber-like material top, the foam base being disposed between the cover and the cushion.

13. A surface for a patient support or a part thereof, the surface comprising:

an anti-shear liner, a cloth covered neoprene cover having an upwardly-facing patient-supporting surface characterized by its stretchability in one direction being greater than its stretchability in an orthogonal direction, and a cushion layer having an upwardly-facing patient-supporting surface, the anti-shear liner being disposed between the upwardly-facing patient-supporting surfaces of the cover and the cushion layer, whereby the cover can slip relative to the cushion layer.

14. A surface for a patient support or a part thereof, the surface comprising:

a cover, wherein the cover is a highly stretchable material characterized by its stretchability in one direction being greater than its stretchability in an orthogonal direction, a cushion layer, and an anti-shear liner disposed between the cover and on selected portions of the cushion layer to engage the cover, whereby the cover can slip relative to the cushion layer;

wherein the patient support is longitudinally extending between a head end and a foot end, the cover is adapted for placement upon the support so that it is more stretchable in the longitudinal direction, and the anti-shear liner is placed on the cushion layer to extend from adjacent the head end of the patient support to adjacent the foot end of the patient support, the liner having a lateral width less than the width of the cushion layer to provide side edge portions of the cushion layer in direct contact with the cover.

15. The surface of claim 14, wherein the liner has a longitudinal length less than the length of the cushion layer to provide end edge portions of the cushion layer in direct contact with the cover.

16. A surface for a patient support or a part thereof, the surface comprising:

a cushion layer, a cover, an anti-shear liner disposed between the cover and on selected portions of the cushion layer to engage the cover, whereby the cover can slip relative to the cushion layer, the anti-shear liner being adhered to the cushion layer, and a patient-supporting upwardly facing surface extending longitudinally between a head end and a foot end and laterally between a first side and a second side and sidewalls extending downwardly from the patient supporting surface, and wherein the anti-shear liner covers the entire upwardly facing surface but does not engage the sidewalls.

17. The surface of claim 16 and further comprising a bottom coverlet joined to the cover adjacent the sidewalls by a peripherally extending seam.

18. A method for minimizing shear on a patient's skin as the patient rests upon a patient support having a head end, a foot end and longitudinally extending sides such as a surgery table, bed, or stretcher, the method comprising the steps of:

providing a cushion, providing an anti-shear layer over selected portions of the cushion, providing a cover including a highly stretchable upwardly-facing patient-supporting surface having a surface integrity against fluid leakage which is maintained upon stretching of the patient-support surface, and placing the combination of the cushion, anti-shear layer, and cover on the support with the cover facing upwardly and the anti-shear layer below and in contact with the cover and resting on the cushion to permit movement between the cover and the cushion.

19. The surface of claim 13, wherein the patient support is longitudinally extending between a head end and a foot end, and the cover is adapted for placement upon the support so that the upwardly-facing patient-supporting surface of the cover is more stretchable in the longitudinal direction.

20. The method of claim 18 in which the cushion is placed on the support to extend from adjacent the head end to the foot end and to the sides, the anti-shear layer is placed on the cushion to extend longitudinally therealong and to have side edges spaced apart from the sides of the support to leave longitudinal side edge portions of the cushion not covered by the anti-shear layer, and the cover is disposed over the anti-shear layer and side edge portions of the cushion.

21. The method of claim 18 in which the anti-shear layer is disposed on the cushion to leave areas of the cushion not covered by the anti-shear layer and in direct contact with the cover.

22. The method of claim 18 which the cushion comprises a plurality of layers of foam having different densities and recovery.

23. The method of claim 22 in which the plurality of foam layers are disposed at different locations on the patient support to provide a surface having different characteristics at different locations between the head end and foot end and between the side edges.

24. The method of claim 23 in which the anti-shear layer is disposed on the cushion in selected locations to provide areas of the surface having different shear characteristics.

25. The method of claim 24 and further comprising the step of gluing the anti-shear layer to the cushion.

26. A method for minimizing shear on a patient's skin as the patient rests upon a patient support having a head end, a foot and longitudinally extending sides such as a surgery table, bed, or stretcher, the method comprising the steps of:

providing a cushion, providing an anti-shear layer over selected portions of the cushion, providing a cover which is a material characterized by its stretchability in the longitudinal direction being greater than its stretchability from side-to-side, and placing the combination of the cushion, anti-shear layer, and cover on the support with the cover facing upwardly and the anti-shear layer below and in contact with the cover and resting on the cushion to permit movement between the cover and the cushion, the cushion being placed on the support to extend from adjacent the head end to the foot end and to the sides, the anti-shear layer being placed on the cushion to extend longitudinally therealong and to have side edges spaced apart from the sides of the support to leave longitudinal side edge portions of the cushion not covered by the anti-shear layer, and the cover being disposed over the anti-shear layer and side edge portions of the cushion.

27. A surface for a patient support or a part thereof, the surface comprising:

a cushion layer having a patient-supporting upwardly facing surface extending longitudinally between a head end and a foot end and laterally between a first side and a second side and sidewalls extending downwardly from the patient supporting surface, a cover, an anti-shear liner disposed between the cover and on selected portions of the cushion layer to engage the cover, whereby the cover can slip relative to the cushion layer, and wherein the anti-shear liner covers the entire upwardly facing surface but does not engage the sidewalls.

28. The surface of claim 27 and further comprising a bottom coverlet joined to the cover adjacent the sidewalls by a peripherally extending seam.

29. The surface of claim 27 wherein the cover is a highly stretchable material characterized by its stretchability in one direction being greater than its stretchability in an orthogonal direction.

30. A surface for a patient support or a part thereof, the surface comprising:

a cover, wherein the cover is a highly stretchable material characterized by its stretchability in one direction being greater than its stretchability in an orthogonal direction, a cushion layer, and an anti-shear liner disposed between the cover and selected portions of the cushion layer to engage the cover, whereby the cover can slip relative to the cushion layer, wherein the patient support is longitudinally extending between a head end and a foot end, the cover is adapted for placement upon the support so that it is more stretchable in the longitudinaly direction, and the anti-shear liner is placed on the cushion layer to extend from adjacent the head end of the patient support to adjacent the foot end of the patient support, the liner having a longitudinal length less than the length of the cushion layer to provide end edge portions of the cushion layer in direct contact with the cover.

31. The surface of claim 30, wherein the liner has a lateral width less than the width of the cushion layer to provide side edge portions of the cushion layer in direct contract with the cover.

* * * * *